US007901268B2

(12) United States Patent
Itoh et al.

(10) Patent No.: US 7,901,268 B2
(45) Date of Patent: Mar. 8, 2011

(54) METHOD FOR GRINDING JOURNAL SECTION OF WORKPIECE

(75) Inventors: Naoki Itoh, Kariya (JP); Toru Harada, Okazaki (JP); Kenichi Sugiura, Nishio (JP)

(73) Assignee: JTEKT Corporation, Osaka-shi (JP)

( * ) Notice: Subject to any disclaimer, the term of this patent is extended or adjusted under 35 U.S.C. 154(b) by 449 days.

(21) Appl. No.: 12/033,669

(22) Filed: Feb. 19, 2008

(65) Prior Publication Data

US 2008/0207090 A1 Aug. 28, 2008

(30) Foreign Application Priority Data

Feb. 23, 2007 (JP) ..... 2007-044469

(51) Int. Cl.
*B24B 5/42* (2006.01)

(52) U.S. Cl. ..... 451/11; 451/49

(58) Field of Classification Search ..... 451/49, 451/5, 8, 9, 10, 11, 249, 251
See application file for complete search history.

(56) References Cited

U.S. PATENT DOCUMENTS 6,409,573 B1 6/2002 Mukai et al.

*Primary Examiner* — Robert Rose
(74) *Attorney, Agent, or Firm* — Oblon, Spivak, McClelland, Maier & Neustadt, L.L.P.

(57) ABSTRACT

For grinding one of axially spaced journal sections of a workpiece each having a cylindrical surface and a pair of shoulder surfaces extending radially outward from the opposite end portions of the cylindrical surface, a rotating grinding wheel is advanced to grind the shoulder surfaces of one journal section and then to grind the cylindrical surface of the one journal section. At the end of the cylindrical surface grinding, the grinding wheel is retracted by a fixed distance at a slow feed rate and is further retracted at a rapid feed rate. A rest shoe provided on the side opposite to the grinding wheel with the workpiece therebetween is advanced to an advanced position where the rest shoe contacts with another journal section axially spaced from the one journal section to decrease the flection of the workpiece caused by grinding resistance and is retracted away from said another journal section when the fixed-distance retraction of the grinding wheel is completed.

5 Claims, 7 Drawing Sheets

COMPARED EXAMPLE

COMPARED EXAMPLE

METHOD FOR GRINDING JOURNAL SECTION OF WORKPIECE

INCORPORATION BY REFERENCE

This application is based on and claims priority under 35 U.S.C. 119 with respect to Japanese patent application No. 2007-044469 filed on Feb. 23, 2007, the entire content of which is incorporated herein by reference.

BACKGROUND OF THE INVENTION

1. Field of the Invention

The present invention relates to a method for grinding a journal section of a workpiece with a steady rest device being in contact at its rest shoe with a part of the workpiece to decrease the flection of the workpiece.

2. Discussion of the Related Art

In a grinding field of crankshafts for automotive engines, it has been a practice that such a crankshaft is ground at its crankpins while being supported by a work spindle of a grinding machine. In grinding each of the crankpins, a rest shoe of a steady rest device is brought into contact with a cylindrical surface of a journal section which is at a position shifted in the axial direction from a crankpin to be ground, as described in U.S. Pat. No. 6,409,573 (equivalent of Japanese unexamined, published patent application No. 2000-296444) for example. The steady rest device decreases the flection of the crankshaft which flection is caused by grinding resistance applied from a grinding wheel, so that the machining accuracy of the crankpin can be enhanced.

A journal section of the crankshaft is ground in the manner illustrated in FIG. 5. That is, in grinding a journal section J1 on one end side of the crankshaft W with a grinding wheel 17, the grinding of the journal section J1 is performed with a rest shoe 34 of a steady rest device 30 being in contact with a center journal section J3 of the crankshaft W. It is often the case that the grinding of the journal section J1 is performed with a sizing device measuring the diameter of the journal section J1 and the width between shoulder surfaces at the opposite ends of the journal section J1. Where the grinding of the journal section J1 is performed using the sizing device, it becomes difficult to bring the rest shoe 34 into contact with the journal section J1 being ground, and thus, the grinding is practically performed with the rest shoe 34 being in contact with another journal section J3 which is axially spaced from the journal section J1 being ground.

First of all, description will be made regarding a cylindrical grinding machine which is employed for an exemplified grinding method (hereafter referred to as "grinding method in a compared example") for grinding the journal section J1 with the rest shoe 34 of the steady rest device 30 being in contact with the cylindrical surface of the center journal section J3 of the crankshaft W. As shown in FIG. 5, at the rear part of an upper surface of a bed 10 of the cylindrical grinding machine, a pair of guide rails 11 are secured in a horizontal left-right direction (Z-direction), and a feed table 12 is supported and guided on the guide rails 11. Another pair of guide rails 13 are secured on the feed table 12 in a horizontal front-rear direction (X-direction), and a wheel head 14 is supported and guided on the guide rails 13. A wheel spindle (not shown) extending in the Z-direction is rotatably carried in the wheel head 14 and is drivingly rotated by a grinding wheel motor (not shown), built in the wheel head 14, together with a grinding wheel 17 secured to one thereof. As shown in an enlarged fragmentary view of a grinding area encircled in FIG. 5, the grinding wheel 17 is of the configuration that an annular grinding wheel layer in which CBN abrasive grains have been bonded with a vitrified bonding agent is securely provided on the circumferential surface of a grinding wheel core made of, e.g., a metal disc and that the thickness in the axial direction of the grinding wheel layer is somewhat greater than that of the grinding wheel core.

A Z-axis servomotor 15 attached to the bed 10 is drivingly controllable by a numerical controller 18 and feeds the feed table 12 and the wheel head 14 and the grinding wheel 17, which are supported on the feed table 12, through a feed screw 15a in the Z-direction. An X-axis servomotor 16 attached to the feed table 12 is drivingly controllable by the numerical controller 18 and feeds the wheel head 14 and the grinding wheel 17, supported on the wheel head 14, through a feed screw 16*a* in the X-direction. The respective servomotors 15, 16 are provided with encoders, which respectively detect the positions of the feed table 12 and the wheel head 14 to feed the detected positions back to the numerical controller 18.

A work table 20 is fixed at the front part on the operator side (i.e., lower side in FIG. 5) of the upper surface of the bed 10 of the grinding machine, and a work head 21 rotatably carrying a work spindle 22 and a foot stock 23 are provided on the work table 20 in axial alignment to face each other in the Z-direction. Centers 22*a*, 23*a* provided on the work spindle 22 and the foot stock 23 support the opposite ends of the crankshaft (i.e., workpiece) W. The work spindle 22 is drivingly rotatable by a work spindle servomotor 24, which is mounted on the work head 21 to be controllable by the numerical controller 18. The crankshaft W is rotated together with the work spindle 22 with its left end portion engaged with a driving dog (not shown) secured to the work spindle 22. The work spindle servomotor 24 is also provided with an encoder, which detects the rotational position of the work spindle 22 to feed the detected position back to the numerical controller 18.

The crankshaft W is a one-body article, which has five journal sections J1-J5 arranged in axial alignment with a space between each journal section and the next thereto, four pairs of crank arms CA radially extending at opposite end portions of the respective journal sections J1-J5 in parallel relation and four crankpins P1-P4 each jointing the radial outmost end portions of an associated pair of crank arms CA. A large-diameter portion K is formed at one end portion of the crankshaft W which portion is outside a first journal section J1 at the leftmost as viewed in FIG. 5, so that the first journal section J1 has a cylindrical surface S1 and a pair of shoulder surfaces S2, S3 which extend from the opposite end portions of the cylindrical surface S1 radially outward.

A base 31 of the steady rest device 30 is fixed on an operator side edge portion of the bed 10 which portion is on a side opposite to the wheel head 14 with the crankshaft W therebetween. A rest head 32 is supported and guided on the base 31 to be movable in the Z-direction. A servomotor 33 attached to the base 31 is drivingly controllable by the numerical controller 18 and feeds the rest head 32 through a feed screw 33*a* in the Z-direction. A rest shoe 34 which is supported and guided by the rest head 32 to be movable in the X-direction is moved by a servomotor 35 back and forth between predetermined advanced and retracted positions. The respective servomotors 33, 35 are provided with encoders, which respectively detect the positions of the rest head 32 and the rest shoe 34 to feed the detected positions back to the numerical controller 18.

Next, with reference to FIGS. 5 to 7, description will be made regarding the grinding method in the compared example which is implemented in the grinding machine as constructed above. In this compared example, the feed table 12 is moved by the Z-axis servomotor 15 and positions the grinding wheel 17 drivingly rotated by the built-in grinding wheel motor (not shown), to a position where the grinding wheel 17 comes to align with and face the first journal section J1 of the crankshaft W which has been center-supported by the work spindle 22 and the foot stock 23. Then, the wheel head 14 is moved by the X-axis servomotor 16 to make the grinding wheel 17 approach the crankshaft W, whereby a shoulder grinding is first performed with opposite end surfaces of the grinding wheel 17 to simultaneously grind the left and right shoulder surfaces S2, S3 of the first journal section J1 and whereby a cylindrical grinding is then performed with the circumferential surface of the grinding wheel 17 to grind the cylindrical surface S1 of the first journal section J1. Before the feed of the wheel head 12 toward the crankshaft W, the servomotor 33 of the steady rest device 30 is operated by the numerical controller 18 to position the rest head 32 to a position where the rest shoe 34 is aligned with a third journal section J3 (another journal section) which is at a position different axially from the first journal section J1 on the crankshaft W. As is a practice in the grinding field, for a small quantity of allowance in the grinding operation, a pre-machining groove Sa (shown in FIG. 7(*a*)) has been formed at the position of the first journal section J1 of the blank of the crankshaft W through a preceding step such as, e.g., turning, milling or the like. The pre-machining groove Sa has an axial width which is somewhat narrower than the axial width of the annular grinding wheel layer of the grinding wheel 17.

In the inoperative state, as shown in FIG. 5, the grinding wheel 17 is away from the first journal section J1 of the crankshaft W, and the rest shoe 34 of the steady rest device 30 is at a retracted position where it is away from the circumferential surface of the third journal section J3. Thus, the axial center CL of the crankshaft W extends in parallel to the Z-axis, as shown in FIG. 7(*a*). In this state, the work spindle servomotor 24 is operated by the numerical controller 18 to rotate the work spindle 22 and the crankshaft W supported thereby, and as indicated by the solid line A in FIG. 6, the wheel head 14 is advanced at a rapid feed rate, whereby the grinding wheel 17 advancing together with the wheel head 14 approaches the first journal section J1 of the crankshaft W.

Somewhat before the circumferential surface of the grinding wheel 17 reaches the shoulder surfaces S2, S3 of the first journal section J1, the numerical controller 18 operates the servomotor 35 of the steady rest device 30 to advance the rest shoe 34 to an advanced position where the rest shoe 34 comes into contact with the external surface of the third journal section J3 of the crankshaft W. Thus, the axial center area of the crankshaft W is somewhat flexed toward the wheel head 14 side, and this causes the first journal section J1 to tilt counterclockwise, as shown in FIG. 7(*b*). Although FIG. 7 depicts the tilt in an exaggerated scale for ease to see, the flection that the push by the rest shoe 34 brings about in the neighborhood of the third journal section J3 of the crankshaft W is in a range of several ten-micron meters, and the displacement which the flection gives to the maximum diameter portion of each shoulder surface S2, S3 extending perpendicular to the axial center CL at the first journal section J1 of the crankshaft W is as extremely small as several micron meters or so.

With the advance of the wheel head 14, the circumferential surface of the grinding wheel 17 advancing with the wheel head 14 reaches the shoulder surfaces S2, S3 of the first journal section J1, and the numerical controller 18 then operates the X-axis servomotor 16 to switch the feed rate of the wheel head 14 from the rapid feed rate to a shoulder grinding feed rate slower than the rapid feed rate, whereby the grinding of the left and right shoulder surfaces S2, S3 begins. During the shoulder grinding, small grinding resistance is generated, and this causes the first journal section J1 to tilt slightly clockwise from the state shown in FIG. 7(*b*). In this state, the shoulder grinding indicated by the solid line B in FIG. 6 is performed to grind the left and right shoulder surfaces S2, S3, as shown in FIG. 7(*c*).

The further advance of the wheel head 14 makes the shoulder grinding progress. When the circumferential surface of the grinding wheel 17 reaches a bottom surface of the pre-machining groove Sa of the first journal section J1 as shown in FIG. 7(*c*), the feed rate of the wheel head 14 is switched to a cylindrical grinding feed rate slower than the shoulder grinding feed rate in the same manner as described above, whereby the grinding indicated by the solid line C in FIG. 6 is initiated on the cylindrical surface S1 of the first journal section J1. During this cylindrical grinding, the grinding resistance increases to be considerably greater than that during the shoulder grinding. The first journal section J1 is tilted clockwise from the state shown in FIG. 7(*c*), and the cylindrical grinding indicated by the solid line C in FIG. 6 is performed in this state. In this cylindrical grinding, due to the clockwise tilt, the shoulder surface S3 on the left side is ground with the left end surface of the grinding wheel 17 to a larger depth as shown in FIG. 7(*d*) than it was ground in the state of FIG. 7(*c*), and a clearance is made between the shoulder surface S2 on the right side and the right end surface of the grinding wheel 17. The cylindrical grinding is subdivided into a first rough grinding (solid line C1), a second rough grinding (solid line C2), a fine grinding (solid line C3) and a minute grinding (solid line C4) wherein the feed rate of the wheel head 14 are in turn reduced stepwise and also into a spark-out grinding (indicated by the first dotted circle at the end of the solid line C4 in FIG. 6) which is performed, with the infeed of the wheel head 14 being stopped, in succession to the minute grinding. The whole operation in the cylindrical grinding is as described above.

To follow the spark-out grinding on the cylindrical surface S1, the wheel head 14 is retracted by a predetermined or fixed distance, as indicated by the solid line D in FIG. 6. If the retraction of the grinding wheel 17 at a rapid feed rate were performed immediately after the grinding of the cylindrical surface S1 is completed, the flection of the crankshaft W would be released at a moment, resulting in a further infeed of a part of the cylindrical surface S1 against the grinding wheel 17, whereby the roundness of the finished cylindrical surface S1 would be degraded in accuracy. The retraction of the fixed distance indicated by the solid line D in FIG. 6 is to prevent the cylindrical surface S1 from being degraded in roundness by retracting the grinding wheel 17 by the predetermined or fixed distance at a slow feed rate, and the distance or amount of the retraction is a small amount. Thus, even though the retraction by the fixed distance decreases the grinding resistance, there remains grinding resistance of the same degree as that in the shoulder grinding. The remaining grinding resistance thus causes the first journal section J1 to tilt counterclockwise from the state shown in FIG. 7(*d*). As a consequence, as shown in FIG. 7(*e*), the clearance which has been made between the shoulder surface S2 on the right side and the right end surface of the grinding wheel 17 during the cylindrical grinding is reduced to zero (0), whereas a clearance is made between the shoulder surface S3 on the left side and the left end surface of the grinding wheel 17.

After being stopped momentarily (as indicated by the second dotted circle in FIG. 6) at the retracted end of the fixed-distance retraction indicated by the solid line D in FIG. 6, the wheel head 14 is further retracted at a semi-rapid feed rate as indicated by the solid line E. During this retraction state, the grinding resistance caused by the grinding wheel 17 becomes zero (0) to return to the state shown in FIG. 7(*b*). Thus, the tilt of the first journal section J1 toward the counterclockwise direction which tilt is brought about by the rest shoe 34 remaining in contact with the third journal section J3 becomes larger in value than that during the shoulder grinding shown in FIG. 7(*c*). As a result, during the retraction at the semi-rapid feed rate, the grinding wheel 17 is retracted with the right end surface thereof interfering with the shoulder surface S2 on the right side of the first journal section J1. This causes vortex or spiral-like shallow scrapes to be formed at the shoulder surface S2 of the first journal section J1. This could make grinding burn on the shoulder surface S2 in the case of the grinding wheel 17 being low in sharpness. Also during the retraction, a clearance is made between the left end surface of the grinding wheel 17 and the shoulder surface S3 on the left side of the first journal section J1.

When the semi-rapid feed retraction of the wheel head 14 makes the circumferential surface of the grinding wheel 17 go away radially outside from an area facing the shoulder surfaces S2, S3 of the first journal section J1, the numerical controller 18 operates the servomotor 35 of the steady rest device 30 whereby the rest shoe 34 is retracted toward the retracted position where it is away from the external surface of the third journal section J3. Thus, the axial center CL of the first journal section J1 of the crankshaft W is brought into a parallel relation with the Z-direction, as shown in FIG. 7(*g*). In this state, the wheel head 14 is retracted at the rapid feed rate indicated by the solid line F in FIG. 6 to return to the initial inoperative state mentioned in the beginning of this operational description.

As described above, in the compared example shown in FIGS. 5-7, there arises a problem that spiral shallow scratches or scrapes or, on a certain occasion, grinding burn is formed on the shoulder surface S2 of the first journal section J1 when the grinding wheel 17 is retracted at the semi-rapid feed rate following the fixed-distance retraction.

SUMMARY OF THE INVENTION

It is therefore a primary object of the present invention to provide a grinding method which does not involve the aforementioned drawback in grinding a journal section of a workpiece.

Briefly, according to the present invention, there is provided a method of grinding one of journal sections axially spaced on the axis of a workpiece with a rotating grinding wheel, with the workpiece being rotatably supported by a work spindle of a cylindrical grinding machine, each of the journal sections having a cylindrical surface and a pair of shoulder surfaces extending radially outward at opposite end portions of the cylindrical surface. The method comprises the steps of feeding the grinding wheel in a radial direction first to grind the shoulder surfaces of one journal section and then to grind the cylindrical surface of the one journal section; advancing a rest shoe, provided on a side opposite to the grinding wheel with the workpiece therebetween, to an advanced position where the rest shoe contacts with another journal section axially spaced from the one journal section to decrease the flection of the workpiece caused by grinding resistance; retracting the grinding wheel by a fixed distance at a slow feed rate upon completion of the cylindrical surface grinding; retracting the rest shoe away from said another journal section upon completion of the fixed-distance retraction of the grinding wheel; and retracting the grinding wheel at a rapid feed rate after the rest shoe goes away from said another journal section.

With this construction, when the rest shoe is retracted upon completion of the fixed-distance retraction of the grinding wheel, the tilt caused by the rest shoe of the journal section being ground is removed, and thus, one of the shoulder sections at the opposite ends of the journal section is ground with one end surface of the grinding wheel before the subsequent rapid feed retraction. Therefore, the rapid feed retraction of the grinding wheel is performed without making each of the end surfaces of the grinding wheel interfere with any shoulder surface of the workpiece, so that the shoulder surfaces of the journal section can be prevented from having any scrape or scratches of spiral-form and any grinding burn thereon.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENTS

First Embodiment

Hereafter, with reference to FIGS. 1, 2 and 5, description will be made regarding a workpiece journal section grinding method in a first embodiment according to the present invention. A cylindrical grinding machine employed in implementing the grinding method in the first embodiment takes the construction shown in FIG. 5. Since the grinding machine has already been described in connection with the foregoing grinding method in the compared example, the detailed description of the grinding machine is omitted for the purpose of avoiding repetition. Further, the material or blank of a crankshaft W to be ground in the grinding method in the first embodiment is the same as that used in the grinding method in the compared example.

Figure 6:
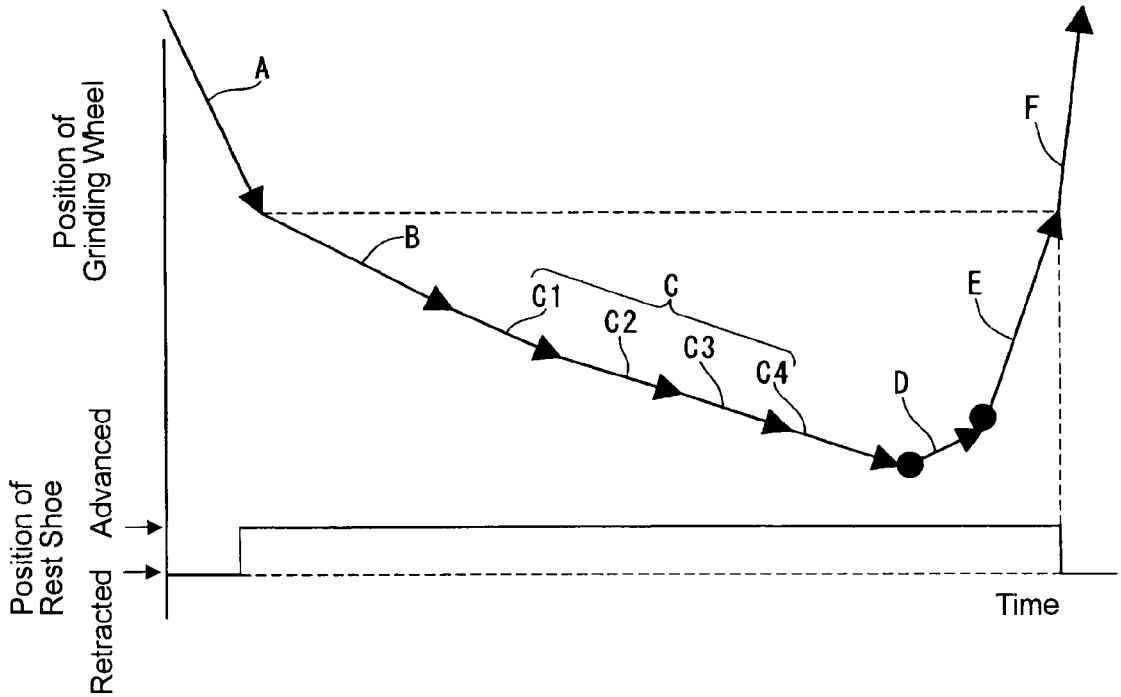
FIG. 6 is a chart depicting operational steps of a grinding cycle in the workpiece journal section grinding method in the compared example.
Figure 7A:
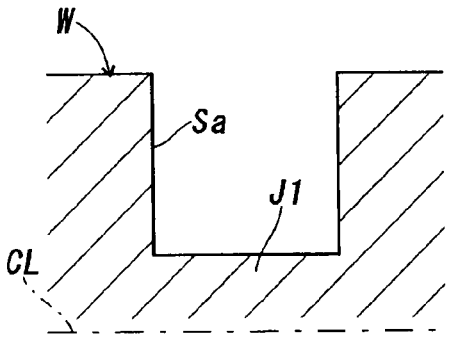
FIGS. 7(*a*)-7(*g*) are enlarged fragmentary views showing respective states in the neighborhood of a first journal section at the respective operational steps of the grinding cycle in the compared example.
Figure 7B:
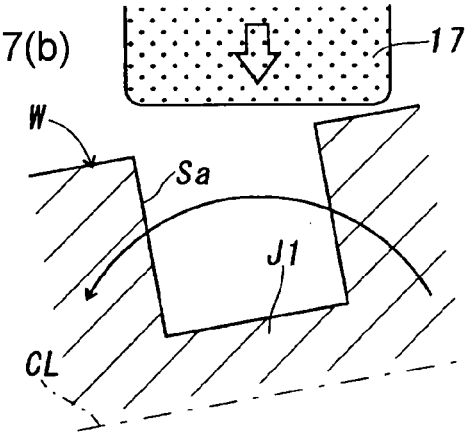
Figure 7C:
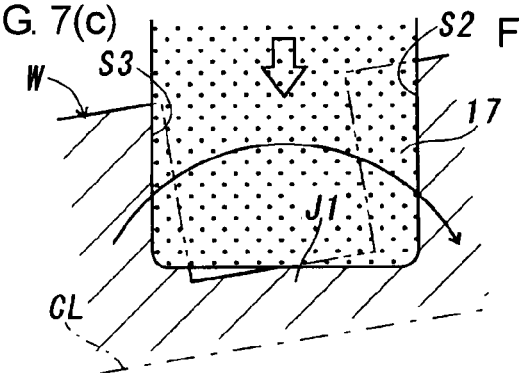
Figure 7D:
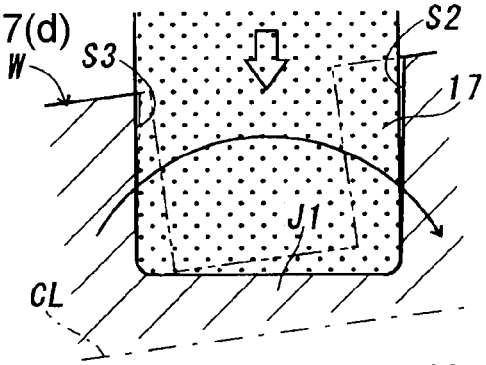
Figure 7E:
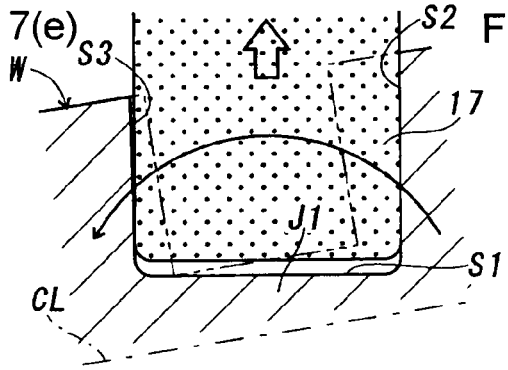
Figure 7F:
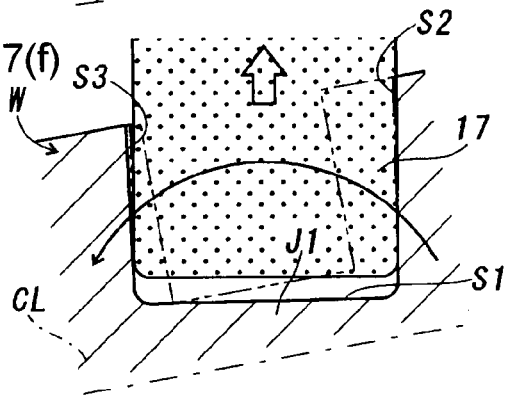
Figure 7G:
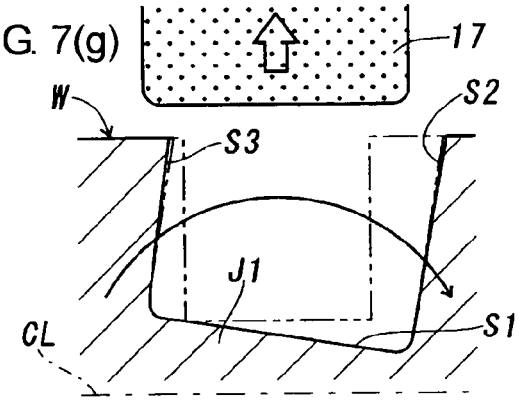

Also in this first embodiment, the grinding steps are performed in the same way as those described in the foregoing compared example. Specifically, the respective servomotors 15, 16, 24, 33 and 35 are controlled by the numerical controller 18, and the cylindrical, external surface S1 of the first journal section J1 and the pair of shoulder surfaces S2, S3 extending radially outward from the opposite end portions of the first journal section J1 are ground by positioning the grinding wheel 17 and the rest shoe 34 relative to the crankshaft W which is supported by the respective centers of the work head 22 and the foot stock 23, moving the wheel head 14 as indicated by the solid lines A-F in FIG. 1 to effect a rapid feed advance (cf. solid line A), a shoulder grinding (cf. solid line B), a cylindrical grinding (cf. solid line C), a fixed-distance retraction (cf. solid line D), a semi-rapid feed retraction (cf. solid line E) and a rapid feed retraction (cf. solid line F) and at the same time as the grinding feed, advancing the rest shoe 34 as indicated by the solid line at the bottom of the chart depicted in FIG. 1. The operational step cycle chart depicted in FIG. 1 indicates the respective positions of the wheel head 14 in connection with the lapse of time and is the same as that in the compared example shown in FIG. 6. However, the operational chart at the bottom in FIG. 1 depicting the feed operation of the rest shoe 34 differs from that at the bottom in FIG. 6 for the compared example in that the time at which the rest shoe 34 at an advanced position is switched to be moved toward a retracted position is not the time of completing the semi-rapid feed retraction (as is the case of the compared example) but the time of completing the fixed-distance retraction (as is the case of the first embodiment).

FIGS. 2(*a*)-2(*g*) are enlarged fragmentary views showing the states of the first journal section J1 at respective time points. As mentioned earlier, the grinding cycle chart depicted in FIG. 1 for the first embodiment is the same as that depicted in FIG. 6 for the compared example, whereas the rest feed chart shown in FIG. 1 for the first embodiment differs from that shown in FIG. 6 for the compared example only in the time point at which the rest shoe 34 is switched to be moved from the advanced position toward the retracted position. That is, FIGS. 2(*a*)-2(*e*) are identical respectively to FIGS. 7(*a*)-7(*e*), and FIGS. 2(*f*) and 2(*g*) only differ from FIGS. 7(*f*) and 7(*g*). Therefore, description will be omitted regarding the states shown in FIGS. 2(*a*)-2(*e*) and will be described hereafter regarding the states shown in FIGS. 2(*f*) and 2(*g*).

Figure 1:
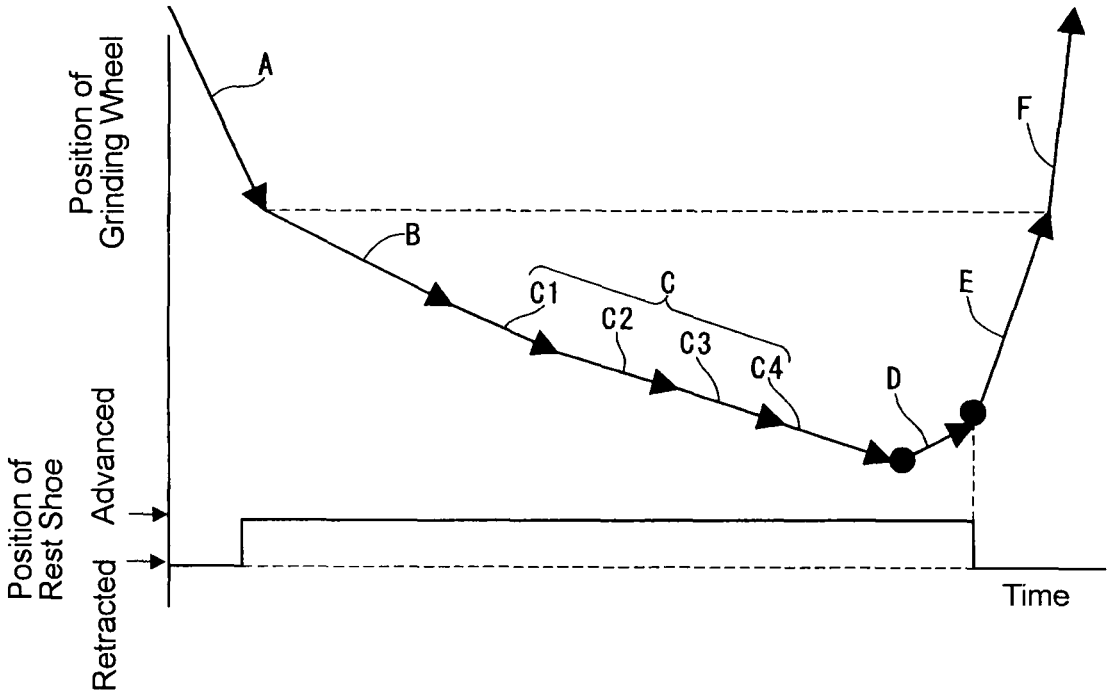
FIG. 1 is a chart depicting operational steps of a grinding cycle in a first embodiment of a workpiece journal section grinding method according to the present invention.
Figure 2A:
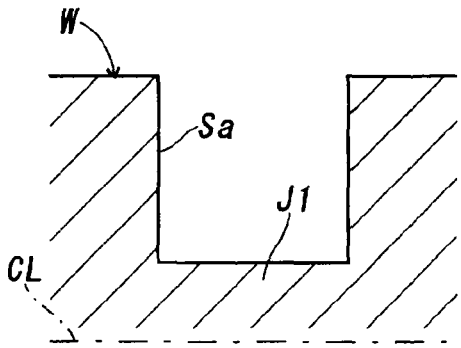
FIGS. 2(*a*)-2(*g*) are enlarged fragmentary views showing respective states in the neighborhood of a first journal section at the respective operational steps of the grinding cycle in the first embodiment.
Figure 2B:
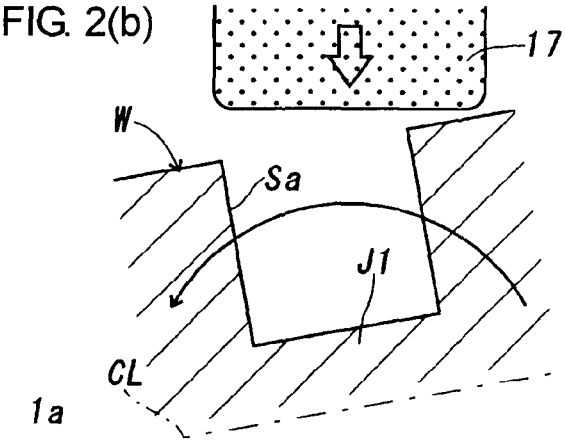
Figure 2C:
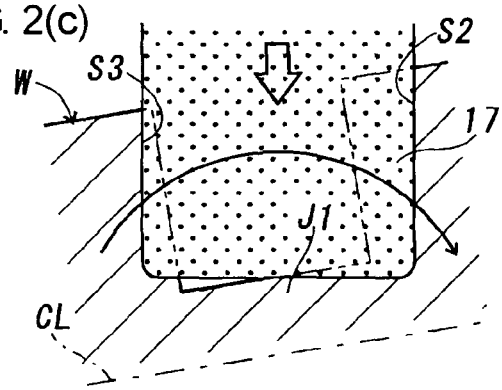
Figure 2D:
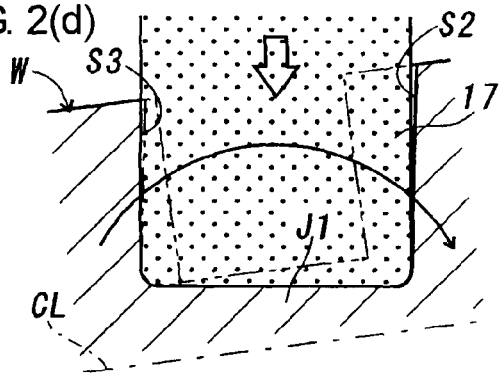
Figure 2E:
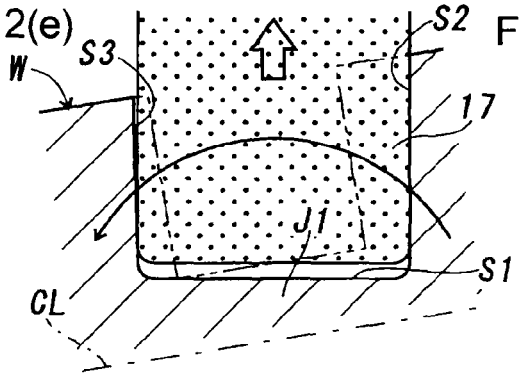
Figure 2F:
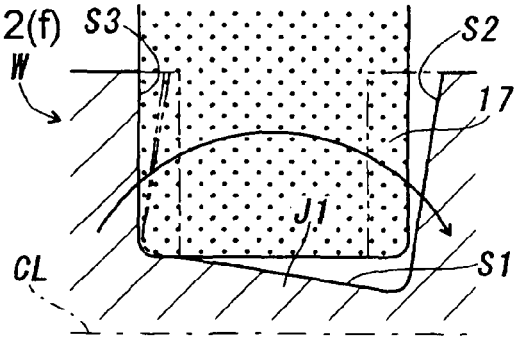
Figure 2G:
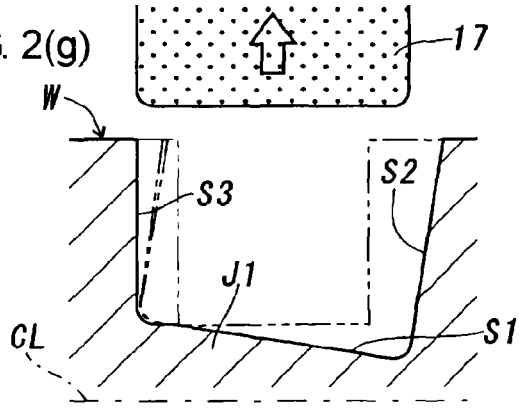

Following the fixed-distance retraction indicated by the solid line D in FIG. 1, the numerical controller 18 operates the servomotor 35 of the steady rest device 30 to retract the rest shoe 34 toward the retracted position away from the external surface of the third journal section J3. Thus, as shown in FIG. 2(*f*), the axial center line CL of the first journal section J1 of the crankshaft W goes back to a position where it is laid in parallel with the Z-direction, whereby the shoulder surface S3 on the left side is given a deeper infeed of the left end surface of the grinding wheel 17 than it is given in the state shown in FIG. 2(*e*), whereas a clearance is formed between the shoulder surface S2 on the right side and the right end surface of the grinding wheel 17. The infeed grinding is completed through a subsequent spark-out grinding indicated by the second dotted circle in FIG. 1, and then, the semi-rapid feed retraction is performed as indicated by the solid line E in FIG. 1. In this state, because of having the clearance relative to the right end surface of the grinding wheel 17, the shoulder surface S2 on the right side does not suffer any scrapes or grinding burn. The shoulder surface S3 on the left side does not interfere with the left end surface of the grinding wheel 17 though remaining in contact therewith, so that the shoulder surface S3 does not suffer any scrapes or grinding burn.

By the semi-rapid feed retraction of the wheel head 14, the circumferential surface of the grinding wheel 17 goes away radially outside from the area facing the shoulder surfaces S2, S3 of the first journal section J1. Thereafter, a rapid feed retraction indicated by the solid line F in FIG. 1 is performed, whereby return is made to the initial inoperative state described in the beginning of this operational description.

In the foregoing first embodiment, the fixed-distance retraction includes the spark-out grinding (the aforementioned second dotted circle) in which the grinding wheel 17 is stopped momentarily following the retraction through the fixed distance. Although being performed for the purposed of completing the infeed grinding on the shoulder surface S3, the spark-out grinding may be omitted as the case may be. In this modified form, an area on the shoulder surface S3 to be ground with the end surface of the grinding wheel 17 is suppressed to a permissible degree by reducing the feed rate at an early stage of the semi-rapid feed retraction following the fixed-distance retraction, and upon completion of the grinding, the grinding wheel 17 is retracted at the semi-rapid feed rate without making the end surfaces thereof interfere with any of the shoulder surfaces S2, S3. In another modified form, it is possible to omit the semi-rapid feed retraction indicated by the solid line E in FIG. 1 and to simultaneously perform the retraction of the rest shoe 34 and the rapid feed retraction (solid line F) of the wheel head 14 in succession to the fixed-distance retraction indicated by the solid line D. Although the simultaneous retractions can be done without performing the spark-out grinding indicated by the aforementioned second dotted circle in FIG. 1, they may preferably be done to follow the spark-out grinding.

Second Embodiment

Figure 3:
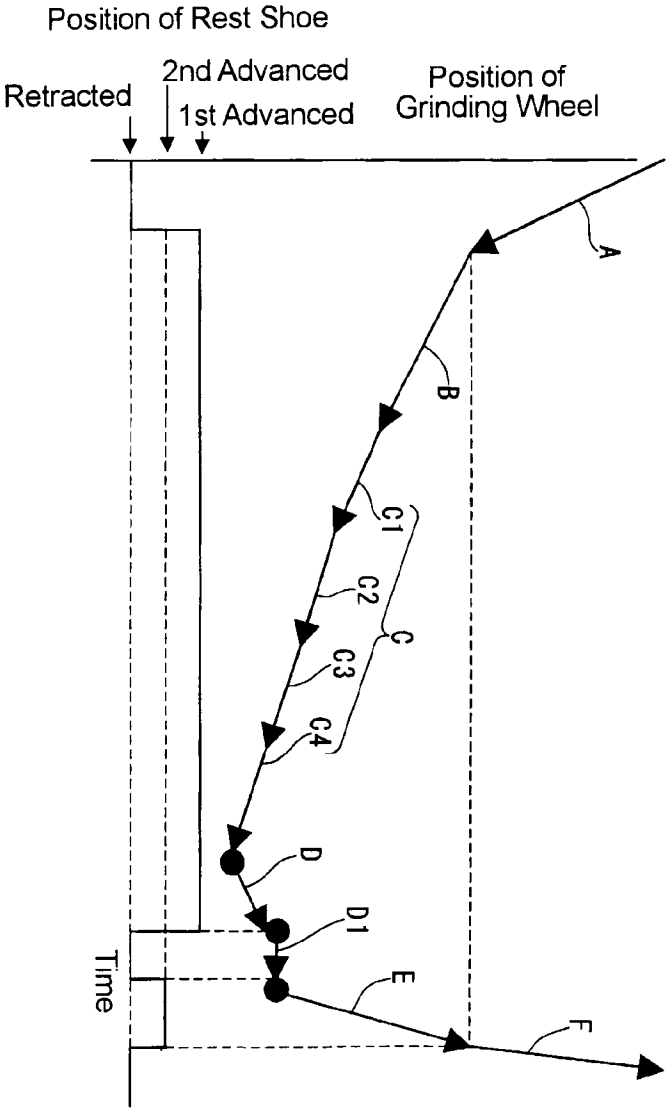
FIG. 3 is a chart depicting operational steps of a grinding cycle in a second embodiment of the workpiece journal section grinding method according to the present invention.
Figure 4A:
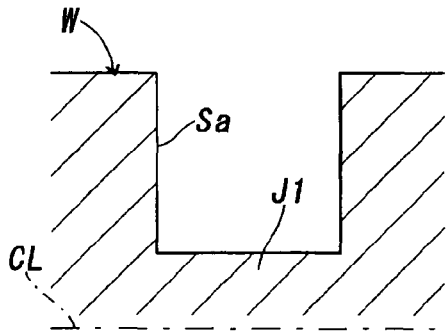
FIGS. 4(*a*)-4(*h*) are enlarged fragmentary views showing respective states in the neighborhood of a first journal section at the respective operational steps of the grinding cycle in the second embodiment shown in FIG. 3.
Figure 4B:
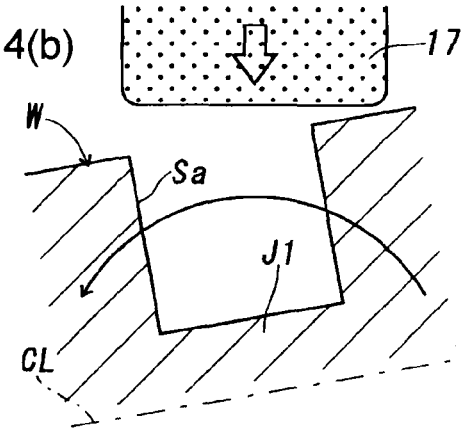
Figure 4C:
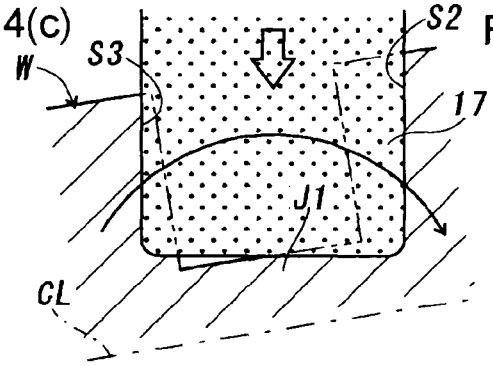
Figure 4D:
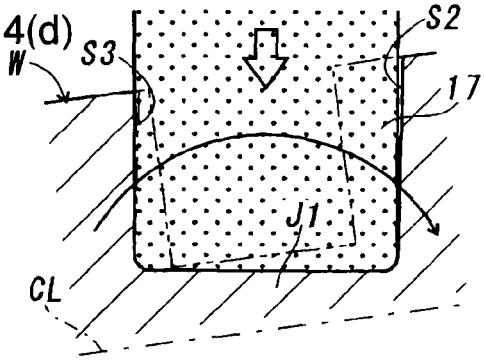
Figure 4E:
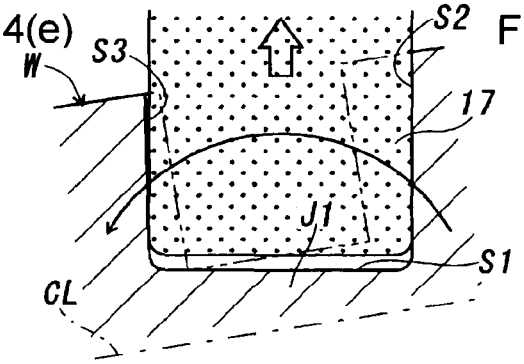
Figure 4F:
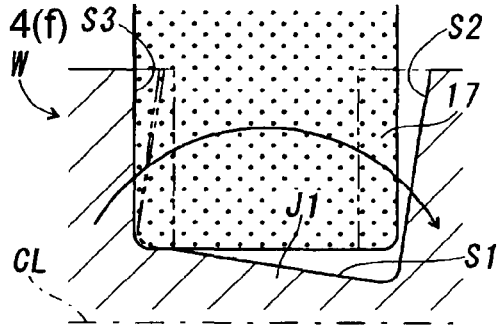
Figure 4G:
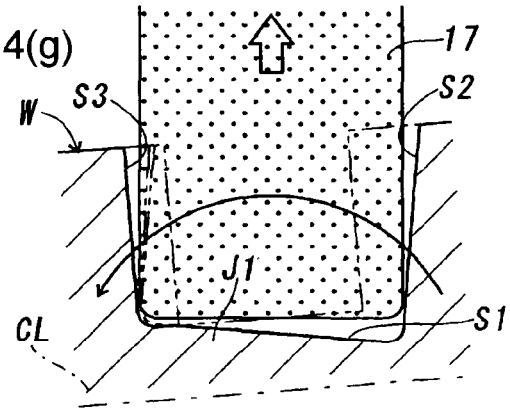
Figure 4H:
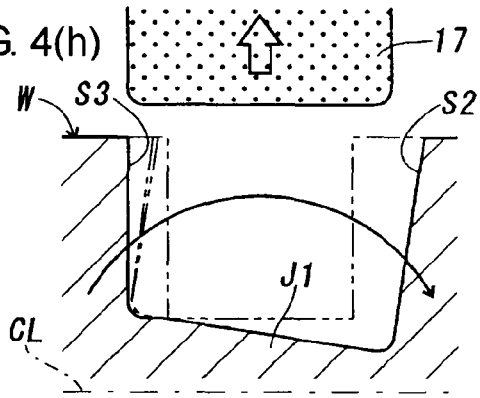

Next, a workpiece journal section grinding method in a second embodiment according to the present invention will be described with reference to FIGS. 3 and 4. Also in the grinding method in this second embodiment, a cylindrical grinding machine and the blank of a workpiece W are the same as those in the foregoing compared example and the foregoing first embodiment. In this second embodiment, as indicated by the solid lines A-F in FIG. 3, the wheel head 14 is moved to perform a rapid feed advance (cf. solid line A), a shoulder grinding (cf. solid line B), a cylindrical grinding (cf. solid line C), a fixed-distance retraction (cf. solid line D), a semi-rapid feed retraction (cf. solid line E) and a rapid feed retraction (cf. solid line F). The difference from the first embodiment is in a respect that the duration for which the wheel head 14 is stopped temporarily at the end of the fixed-distance retraction indicated by the solid line D is made to be longer by a period indicated by the solid line D1 than the corresponding duration in the foregoing first embodiment. Also in this second embodiment, as indicated by the solid line at the bottom in FIG. 3, the rest shoe 34 is advanced to, and retracted from, a first advanced position at the same timings as those in the foregoing first embodiment. Then, the rest shoe 34 is re-advanced to a second advanced position prior to the initiation of the semi-rapid feed retraction (the solid line E) and is then retracted from the second advanced position toward the retraction position at the time point when the semi-rapid feed retraction (the solid line E) is terminated. The first advanced position is the same position as the advance position in the foregoing first embodiment, whereas the second advance position is an intermediate position which is along the way to the first advance position and which is another predetermined distance behind the first advanced position. The rest shoe 34 at the intermediate position still remains in contact with the external surface of the third journal section J3. That is, the second embodiment differs from the foregoing first embodiment in that at the end of the fixed-distance retraction, the grinding wheel 17 is temporarily stopped by a longer duration D1 than the corresponding duration in the foregoing first embodiment and that during the duration D1, the rest shoe 34 is retracted to a position which is away from the journal section J3 and is then re-advanced to the second advance position which is the predetermined distance to the first advance position, to contact with the third journal section J3. The position to which the rest shoe 34 is retracted away from the journal section J3 during the duration D1 may be the retracted position as indicated in FIG. 3 or another intermediate position between the second advanced position and the retracted position.

FIGS. 4(*a*)-4(*h*) are enlarged fragmentary views showing the states of the first journal section J1 at respective time points and are similar to FIGS. 2(*a*)-2(*g*) for the foregoing first embodiment. The rapid feed advance (cf. solid line A) through the fixed-distance retraction (cf. solid line D) in FIG. 3 are the same as those in FIG. 1, and likewise, FIGS. 4(*a*)-4(*f*) are the same as FIG. 2(*a*)-2(*f*). Therefore, description regarding FIGS. 4(*a*)-4(*f*) will be omitted to avoid repetition, and description will hereafter be made regarding FIGS. 4(*g*)-4(*h*) only.

In the state shown in FIG. 4(*f*), the axial center line CL of the first journal section J1 of the crankshaft W is laid in parallel with the Z-direction, so that the shoulder surface S3 on the left side is in contact with the left end surface of the grinding wheel 17, whereas a clearance is formed between the shoulder surface S2 on the right side and the right end surface of the grinding wheel 17. At this time, the rest shoe 34 is at the retracted position and is away from the external surface of the third journal section J3. In this state, the servomotor 35 of the steady rest device 30 is operated by the numerical controller 18 to bring the rest shoe 34 into contact with the external surface of the third journal section J3 at the second advanced position which is along the way to the first advanced position. This causes the first journal section J1 to tilt counterclockwise from the position which is parallel to the Z-direction. However, because the second advanced position is along the way to the first advanced position, that is, behind the first advanced position, the first journal section J1 is not tilted to the state shown in FIG. 4(*e*) and is stopped between the positions shown in FIGS. 4(*e*) and 4(*f*), as shown in FIG. 4(*g*). As a consequence, the grinding wheel 17 is brought into the state that the both end surfaces of the grinding wheel 17 are respectively spaced from the shoulder surfaces S2, S3 at the opposite ends of the cylindrical surface S1 of the first journal section J1. In this state, the wheel head 14 is retracted at the semi-rapid feed rate as indicated by the solid line E in FIG. 3, so that it can be prevented reliably that any shallow scrape of spiral form or any grinding burn is formed on the shoulder surfaces S2, S3.

After the wheel head 14 is retracted at the semi-rapid feed rate to make the circumferential surface of the grinding wheel 17 go away from the area facing the shoulder surfaces S2, S3 of the first journal section J1, the servomotor 35 of the steady rest device 30 is operated by the numerical controller 18 to retract the rest shoe 34 toward the retracted position away from the external surface of the third journal section J3. As a result, as shown in FIG. 4(*h*), the axial center CL of the first journal section J1 of the crankshaft W becomes parallel to the Z-direction, and in this state, the wheel head 14 is retracted at the rapid feed rate as indicated by the solid line F in FIG. 3, to return to the initial inoperative state.

In each of the foregoing embodiments, description has been made regarding the example that the present invention is applied to grinding the first journal section J1 which is on one axial end side of the crankshaft W. The present invention is not limited to grinding the first journal section J1. It is possible to apply the present invention to grinding any other journal section of the crankshaft or grinding any journal section of a shaft other than the crankshaft.

Figure 5:
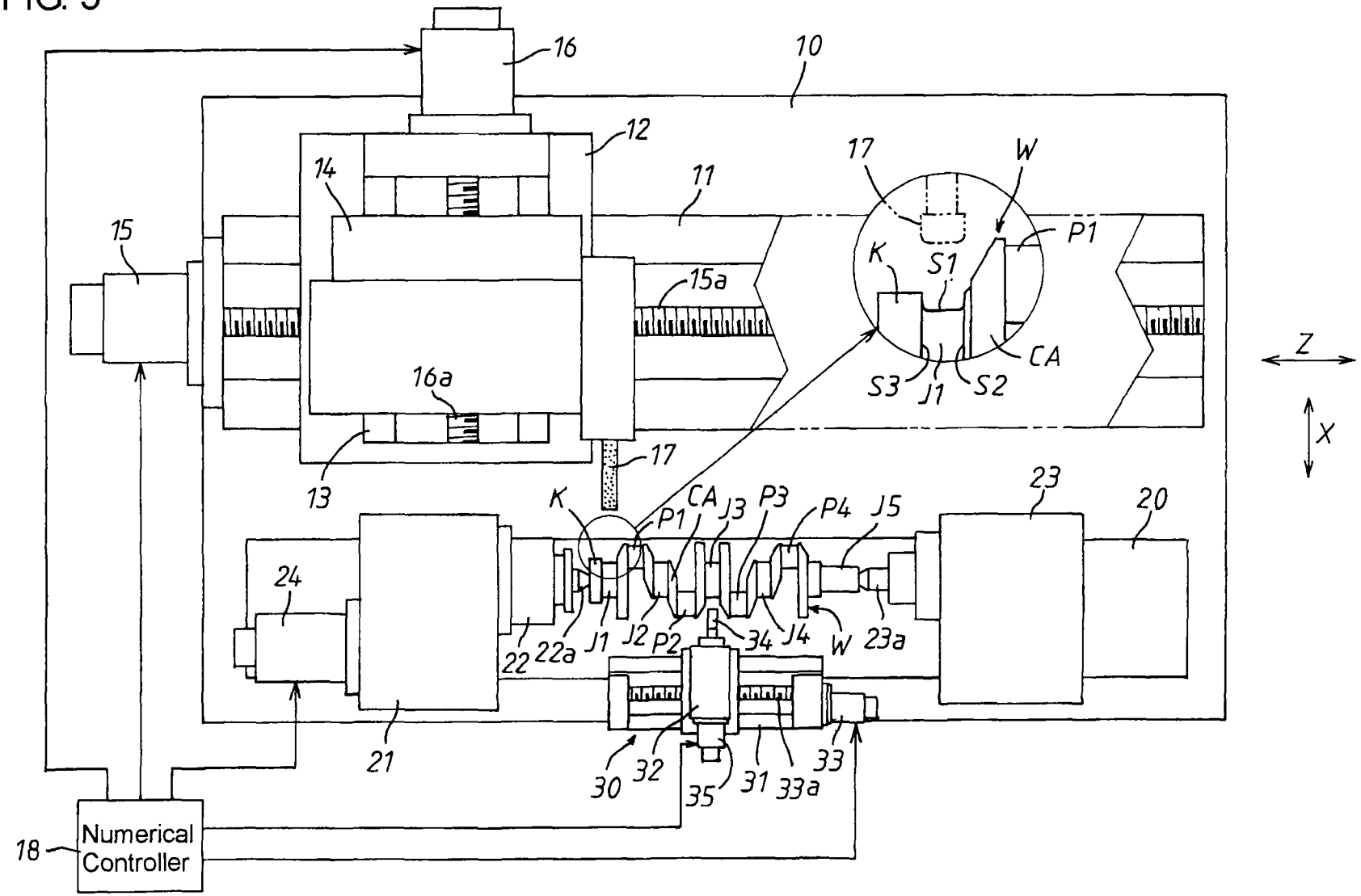
FIG. 5 is a plan view schematically showing the overall construction of a cylindrical grinding machine employed in implementing the respective embodiments according to the present invention and a workpiece journal section grinding method in a compared example.

Various features and many of the attendant advantages in the foregoing embodiments will be summarized as follows:

In the grinding method in the foregoing first embodiment typically shown in FIGS. 1, 2 and 5, when the rest shoe 34 is retracted upon completion of the fixed-distance retraction (D in FIG. 1) of the grinding wheel 17, the tilt caused by the rest shoe 34 of the journal section J1 is removed, and thus, one (S2 or S3) of the shoulder sections is ground with one end surface of the grinding wheel 17 before the subsequent rapid feed retraction including the semi-rapid feed retraction. Therefore, the rapid feed retraction of the grinding wheel 17 is performed without making each of the end surfaces of the grinding wheel 17 interfere with any shoulder surface S2, S3 of the workpiece W, so that the shoulder surfaces S2, S3 of the first journal section J1 can be prevented from having any scrapes or scratches of spiral-form and any grinding burn thereon.

In the grinding method in the foregoing second embodiment typically shown in FIGS. 3 to 5, after being retracted from the first advanced position, the rest shoe 34 is re-advanced to the second advanced position which is on the way to the first advanced position and at which the rest shoe 34 comes to contact with the different journal section J3. This brings the shoulder surfaces S2, S3 into the state that each of the shoulder surfaces S2, S3 is spaced from the associated end surface of the grinding wheel 17, and the rapid feed retraction of the grinding wheel 17 is performed in this state. Accordingly, the shoulder surfaces S2, S3 of the first journal section J1 can be reliably prevented from having any scrape of spiral form and any grinding burn thereon.

Also in the grinding method in the foregoing second embodiment typically shown in FIGS. 3 to 5, after being retracted by the fixed distance (D in FIG. 3), the grinding wheel 17 is temporarily stopped to perform the spark-out grinding (D1 in FIG. 3). This ensures completing the grinding of the shoulder surfaces S2, S3 which is performed as a result that the tilt of the first journal section J1 is removed by the retraction of the rest shoe 34, and thus, it can be prevented that the end surfaces of the grinding wheel 17 are interfered with the shoulder surfaces S2, S3 during the rapid feed retraction. Accordingly, the shoulder surfaces S2, S3 of the first journal section J1 can be reliably prevented from having any scrape of spiral form and any grinding burn thereon.

Also in the grinding method in the foregoing second embodiment typically shown in FIGS. 3 to 5, during the temporal stop (D1 in FIG. 3) of the grinding wheel 17 following the fixed-distance retraction (D in FIG. 3), the rest shoe 34 is retracted from the first advanced position and after this retraction, is re-advanced to the second advanced position which is on the way to the first advanced position and at which it contacts with the different journal section J3. Thus, the subsequent rapid feed retraction of the grinding wheel 17 is performed with the both end surfaces thereof being reliably spaced from the shoulder surfaces of the first journal section J1. Accordingly, the shoulder surfaces S2, S3 of the first journal section J1 can be reliably prevented from having any scrape of spiral form and any grinding burn thereon.

Obviously, numerous further modifications and variations of the present invention are possible in light of the above teachings. It is therefore to be understood that within the scope of the appended claims, the present invention may be practiced otherwise than as specifically described herein.

What is claimed is:

1. A method of grinding one of journal sections axially spaced on the axis of a workpiece with a rotating grinding wheel, with the workpiece being rotatably supported by a work spindle of a cylindrical grinding machine, each of the journal sections having a cylindrical surface and a pair of shoulder surfaces extending radially outward at opposite end portions of the cylindrical surface, the method comprising the steps of:

feeding the grinding wheel in a radial direction first to grind the shoulder surfaces of one journal section and then to grind the cylindrical surface of the one journal section;

advancing a rest shoe, provided on a side opposite to the grinding wheel with the workpiece therebetween, to an advanced position where the rest shoe contacts with another journal section axially spaced from the one journal section to decrease the flection of the workpiece caused by grinding resistance;

retracting the grinding wheel by a fixed distance at a slow feed rate upon completion of the cylindrical surface grinding;

retracting the rest shoe away from said another journal section upon completion of the fixed-distance retraction of the grinding wheel; and commencing retracting the grinding wheel at a rapid feed rate after the rest shoe goes away from said another journal section.

2. The method as set forth in claim 1, further comprising the step of:

re-advancing the rest shoe to an intermediate advanced position, which is along the way to the advanced position, to bring the rest shoe into contact with said another journal section after the step of retracting the rest shoe.

3. The method as set forth in claim 1, wherein the step of retracting the grinding wheel by the fixed distance includes a spark-out grinding in which the grinding wheel is stopped temporarily after being retracted by the fixed distance.

4. The method as set forth in claim 2, wherein the step of retracting the grinding wheel by the fixed distance includes a spark-out grinding in which the grinding wheel is stopped temporarily after being retracted by the fixed distance.

5. The method as set forth in claim 4, wherein the step of retracting the rest shoe away from said another journal section and the step of re-advancing the rest shoe to the intermediate advanced position are performed during the temporal stop of the grinding wheel following the fixed-distance retraction.

* * * * *